United States Patent [19]

Beneke et al.

[11] Patent Number: 4,882,139

[45] Date of Patent: Nov. 21, 1989

[54] IMPROVED PRODUCTION OF CARBON FIBERS

[75] Inventors: Herbert Beneke, Castro-Rauxel; Siegfried Peter, Uttenreuth-Weiher, both of Fed. Rep. of Germany

[73] Assignee: Rutgerswerke AG, Fed. Rep. of Germany

[21] Appl. No.: 277,700

[22] Filed: Nov. 30, 1988

[30] Foreign Application Priority Data

Dec. 8, 1987 [DE] Fed. Rep. of Germany ..... 3741482

[51] Int. Cl.[4] ..... C01B 31/02; C10C 1/00; C10C 1/20

[52] U.S. Cl. ..... 423/447.4; 423/447.1; 423/447.2; 423/447.6; 423/449; 423/447.7; 208/39; 208/43; 208/44; 208/45

[58] Field of Search ..... 423/447.1, 447.2, 447.4, 423/447.7; 208/39, 43, 44, 45

[56] References Cited

U.S. PATENT DOCUMENTS

| | | | |
|---|---|---|---|
| Re. 32,120 | 4/1986 | Low | 208/433 |
| 4,127,472 | 11/1978 | Migilaker et al. | 208/45 |
| 4,184,942 | 1/1980 | Angier et al. | 208/45 |
| 4,259,171 | 3/1981 | Stadelhofer et al. | 207/45 |
| 4,390,411 | 6/1983 | Scinta et al. | 208/433 |
| 4,402,824 | 9/1983 | Sunami et al. | 208/45 |
| 4,482,453 | 11/1984 | Coombs et al. | 208/45 |
| 4,524,499 | 7/1985 | Watanabe | 208/22 |
| 4,529,498 | 7/1985 | Watanabe | 208/22 |
| 4,575,412 | 3/1986 | Yudate et al. | 208/45 |
| 4,631,181 | 12/1986 | Matsumoto et al. | 208/22 |
| 4,756,818 | 7/1988 | Peter et al. | 208/433 |
| 4,789,456 | 12/1988 | Tsuchitani et al. | 208/22 |

*Primary Examiner*—Helane Myers

*Attorney, Agent, or Firm*—Bierman and Muserlian

[57] ABSTRACT

In a process for the production of carbon fibers from high boiling bituminous substances in which a purified and polymerized concentrated carbon fiber precursor is spun into fibers which are oxidized and then carbonized and optionally graphitized, the improvement comprising just before spinning a supercritical gas is dissolved in mesophase pitch at a pressure of 100 to 350 bars and a temperature up to 150° K. below the melting temperature of the mesophase pitch to form a low viscosity melt, separating the latter into an isotropic phase and an anisotropic carbon fiber precursor and spinning the latter into fibers whereby the spinning temperature is lowered and the mesophase contact is increased due to the viscosity lowering activity of the supercritical gas.

7 Claims, No Drawings

PRODUCTION OF CARBON FIBERS

Processes for the production of carbon fibers from high boiling bituminous materials such as coal tar pitch, petroleum pitch, residual oils of coal liquefaction and synthesis pitches are known. The bituminous substances are purified and, possibly after a pretreatment, polymerized. This results in a mesophase pitch with different quantities of anisotropic pitch constituents from which the more readily volatile and the isotropic components must be removed, at least partially, to obtain a carbon fiber preliminary product with a high optical anisotropic fraction.

This preliminary product must meet the following requirements:

(a) The proportion of mesophases should be close to 100%.

(b) The proportion of volatile components should be as low as possible.

(c) The content of solids and/or extraneous substances should be close to 0.

(d) The material being spun should undergo no or only very slight alteration in the extruder.

(e) The spinning temperature should, if possible, be below 573° K. to avoid further polymerization during spinning.

(f) While spinning, the viscosity should be between 100 and 1000 Pas.

The preliminary product is spun through spinnerets and the pitch filament is made non-melting by oxidation, carbonization and optionally graphitization.

The purification of the bituminous material can be effected by filtering, extraction with optional subsequent distilling of the solvent, or by extraction with supercritical gases. This process stage is technically fully developed and the polymerization is carried out at elevated temperature with or without catalyst. The conditions are selected so that as little quinoline insoluble matter (QI) as possible but as high a proportion of optical anisotropic material forms. The tendency to form QI can be reduced by prior hydrogenation but if any catalysts are used, they must be removed from the mesophase pitch without a trace.

To obtain a sufficiently high proportion of anisotropic material during the polymerization, this process step is often carried out under a high vacuum or while introducing a carrier gas. The formation of new quinoline insolubles, however, cannot be avoided entirely so that often an extraction stage must follow the polymerization. If a solvent is used, it must be removed completely from the carbon fiber precursor by distillation under mild conditions. As residue, there remains a highly viscous substance melting at temperatures above about 523° K. which must be spun at temperatures about 60° to 100° K. higher.

Spinning temperatures up to about 673° K. are quite common, but lower temperatures are desirable because they are easier to control. At high temperatures, precursor continues to polymerize and there is danger that solids will form which lead to filament ruptures and even obstruct the spinneret, and/or vaporizing substances will form which also cause defects.

The viscosity during spinning should be between 100 and 1000 Pas and therefore, the flow point of the precursor must be correspondingly low. However, the formed filament should consist of mesophase pitch of high melting point so that during further treatment, the material will not melt again.

OBJECTS OF THE INVENTION

It is an object of the invention to provide an improved process for the production of carbon fibers in which the precursor of high melting point can be spun at comparatively low temperatures.

It is another object of the invention to provide improved carbon fibers free of gas or solid inclusions and defect free.

These and other objects and advantages of the invention will become obvious from the following detailed description.

THE INVENTION

The novel process of the invention a for the production of carbon fibers from high boiling bituminous substances in which a purified and polymerized concentrated carbon fiber precursor is spun into fibers which are oxidized and then carbonized and optionally graphitized, wherein the improvement comprises just before spinning a supercritical gas is dissolved in mesophase pitch at a pressure of 100 to 350 bars and a temperature up to 150° K. below the melting temperature of the mesophase pitch to form a low viscosity melt, separating the latter into an isotropic phase and an anisotropic carbon fiber precursor and spinning the latter into fibers. The preferred pressure is 200 to 300 bars.

Especially suitable as supercritical gas are alkanes or alkenes of 2 to 6 carbon atoms. Optionally, the viscosity effect can be further improved by addition of an entraining agent to the supercritical gas. Especially suitable as entraining agents are aromatic hydrocarbons or aromatic heterocyclics such as phenolic and/or anilines derivatives. After mixing, the mixture is pumped into a settling tank in which the aniostropic precusor and the isotropic phase can separate because of the considerably reduced viscosity. The viscosity reduction of the mesophase pitch occurs already at very low contents of supercritical gas.

It is possible to spin the precursor for more than 60 minutes without filament rupture at temperatures up to 150° K. below the melting point into fibers 10 μm thick. Even after tests lasting several days, the spinnerets showed no clogging. After the spinning, small amounts of gas diffuse out of the fiber without any defects being found in the fiber. A spontaneous increase in viscosity occurs at this stage so that the fiber does not melt again during the subsequent oxidation.

In the following examples there are described several preferred embodiments to illustrate the invention. However, it is to be understood that the invention is not intended to be limited to the specific embodiments.

EXAMPLE 1

100 parts by weight of a mesophase pitch from coal tar having the following properties:

| | |
|---|---|
| Flow point | 370 C |
| Quinoline insolubles | 58% by wt. |
| Toluene insolubles | 92% by wt. |
| Coking residue (alkane) | 96% by wt. |
| Optical anisotropy | 95% by vol. |

were heated with supercritical propane, to which 15% by weight of phenol was added as the entrainer, to 533°

K. in an agitator at a pressure of 250 bars to form a low-viscosity melt. The mixture was transferred to a settling tank and after a settling time of 30 minutes, the bottom phase (optical anisotropy: 100% by vol.) was spun via a spinning pump with a die plate for 15 minutes at a draw-off rate of 500 m/min. The supernatant isotropic phase was drawn off and the gas was separated from the isotropic pitch by release of the pressure and then compressed again to 250 bars and recycled.

The die plate had four holes with a diameter of 0.4 mm and the 10 μm thick pitch filaments were cooled and wound on a roll. The pitch filaments were heated in air at 3° K./min to 423° K. and then at 1° K./min to 573° K. and this temperature was maintained for 30 minutes to stabilize the fibers by oxidation. Then, the stabilized fibers were heated under a nitrogen atmosphere at 5° K./min to 1273° K. and this temperature was maintained for 30 minutes to carbonize the fibers. The carbonized fibers were graphitized in an argon stream with a temperature rise of 25° K./min to 2773° K. The tensile strength was 2.5° kN/mm$^2$ with a modulus of elasticity of 0.4 MN/mm$^2$. No inclusions of gas or solids appear at the fractures.

EXAMPLE 2

The charge product of Example 1 was mixed at 250 bars pressure and a temperature of 523A° K. with propene containing 15% by weight of phenol and was processed further as in Example 1 to obtain a pitch fiber which was unleltable at the spinning temperature and which could be further processed without difficulties as in Example 1 to a carbon fiber.

EXAMPLE 3

The charge product of Example 1 was mixed at 250 bars pressure and 523° K. with butene without addition of an entrainer and processed further as in Example 1 to obtain a pitch fiber which was not meltable at the spinning temperature and which could be further processed without difficulties as in Example 1 to a carbon fiber.

EXAMPLE 4

The charge product of Example 1 was treated at 300 bars pressure and 503° K. with butene containing 15% by weight of phenol and further processed as described in Example 1 to obtain a pitch fiber which after the spinning process was unmeltable at the spinning temperature and which could be further processed without difficulties as in Example 1 to a carbon fiber.

EXAMPLE 5

The charge product of Example 1 was treated with propene at 300 bars pressure and a temperature of 523° K. and was further processed as described in Example 1 to obtain a pitch fiber which after relaxation was unmeltable in the spinning process at the spinning temperature and which could be further processed to a carbon fiber without difficulties as in Example 1.

EXAMPLE 6

The charge product of Example 1 was treated at 200 bars pressure and 543° K. with propene containing 30% by weight of phenol and was further processed as described in Example 1 to obtain a pitch fiber which after relaxation was unmeltable in the spinning process at the spinning temperature and which could be further processed to a carbon fiber as in Example 1.

Various modifications of the process and the fibers of the invention may be made without departing from the spirit or scope thereof and it is to be understood that the invention is intended to be limited only as defined in the appended claims.

What we claim is:

1. In a process for the production of carbon fibers from high boiling bituminous substances in which a purified and polymerized concentrated carbon fiber precursor containing mesophase pitch is spun into fibers which are oxidized and then carbonized and optionally graphitized, the improvement consisting essentially of just before spinning a supercritical gas is dissolved in mesophase pitch at a pressure of 100 to 350 bars and a temperature up to 150° K. below the melting temperature of the mesophase pitch to form a low viscosity melt, separating the latter by settling into an isotropic phase and an anisotropic carbon fiber precursor and spinning the latter at the said temperature into fibers.

2. The process of claim 1 wherein the pressure is 200 to 300 bars.

3. The process of claim 1 wherein the supercritical gas is an alkane or alkene of 2 to 6 carbon atoms.

4. The process of claim 1 wherein the supercritical gas contains an entraining agent.

5. The process of claim 4 wherein the an entraining agent is at least one member of the group consisting of aromatic hydrocarbons, aromatic heterocyclics, phenolic and aniline derivatives.

6. The process of claim 1 wherein the separation is effected by settling with a gas phase forming above the isotropic phase.

7. The process of claim 6 wherein the isotropic phase and the gas phase are depressurized together in a separator and the gas phase is repressurized and recycled.

* * * * *